United States Patent [19]

Klingel

[11] Patent Number: 4,753,099

[45] Date of Patent: Jun. 28, 1988

[54] BENDING PRESS FOR SHEET METAL

[75] Inventor: Hans Klingel, Moeglingen, Fed. Rep. of Germany

[73] Assignee: Trumpf GmbH & Co., Fed. Rep. of Germany

[21] Appl. No.: 904,168

[22] Filed: Sep. 5, 1986

[30] Foreign Application Priority Data

Sep. 18, 1985 [DE] Fed. Rep. of Germany ..... 3533235

[51] Int. Cl.[4] ..... B21D 5/02

[52] U.S. Cl. ..... 72/389; 72/381; 72/386; 72/421; 72/455; 72/22; 72/295; 72/446; 72/448

[58] Field of Search ..... 72/381, 382, 383, 385, 72/386, 389, 421, 419, 22, 23, 418, 455, 446, 448, 295, 305, 296, 297

[56] References Cited

U.S. PATENT DOCUMENTS

| | | | |
|---|---|---|---|
| 725,157 | 4/1903 | Heldon . | |
| 1,933,450 | 2/1933 | Ralston et al. . | |
| 2,627,890 | 2/1952 | Lloyd et al. . | |
| 3,214,955 | 11/1961 | Voth . | |
| 3,650,133 | 3/1972 | Bredow . | |
| 3,703,094 | 11/1972 | Cree, Jr. . | |
| 3,838,590 | 10/1974 | Van Dijk | 72/381 |
| 3,851,518 | 12/1974 | Spengler | 72/381 |
| 3,855,840 | 12/1974 | Kawano . | |
| 3,892,155 | 7/1975 | Gerlach . | |
| 4,030,364 | 6/1977 | Atwood . | |
| 4,114,418 | 9/1978 | Jarman . | |
| 4,166,369 | 9/1979 | Nakajima . | |
| 4,341,104 | 7/1982 | Jarman . | |
| 4,347,726 | 9/1982 | Naslund . | |
| 4,347,727 | 9/1982 | Galiger . | |
| 4,357,821 | 11/1982 | Fowler . | |
| 4,378,688 | 4/1983 | Spanke et al. . | |
| 4,411,150 | 10/1983 | Klein et al. . | |
| 4,510,789 | 4/1985 | Tomioka et al. . | |
| 4,680,955 | 7/1987 | Sakamoto | 72/389 |

FOREIGN PATENT DOCUMENTS

| | | | |
|---|---|---|---|
| 0100420 | 7/1982 | European Pat. Off. . | |
| 0110655 | 11/1982 | European Pat. Off. . | |
| 0140394 | 10/1983 | European Pat. Off. . | |
| 2542239 | 9/1975 | Fed. Rep. of Germany . | |
| 2844867 | 10/1978 | Fed. Rep. of Germany . | |
| 3407445 | 2/1984 | Fed. Rep. of Germany . | |
| 1296690 | 5/1962 | France | 72/381 |
| 7309216 | 3/1973 | France . | |
| 0153711 | 7/1963 | U.S.S.R. | 72/381 |

OTHER PUBLICATIONS

"Trumaform 400 Bending Cell", Trumpf Inc., pp. 1-11, Feb. 1987.

*Primary Examiner*—David Jones

[57] ABSTRACT

A bending press includes a work support table comprised of a pair of support elements, at least one of which is mounted on the frame for movement generally vertically relative to the work support plane. Workpiece positioning elements are located on opposite sides of the work station defined by the upper and lower dies and are movable horizontally of the work support plane defined by the work support table. A drive motor effects horizontal movement of at least one of the workpiece positioning elements relative to the other positioning elements so as to move the workpiece on the work support table and effect its precise positioning in desired positions relative to the work station. The machine includes a computer control for operating the various drive motors and may include a rotatable work support table for effecting rotation of the workpiece to reorient it relative to the work station. Moreover, the press may include magazines which store a multiplicity of dies and die changing apparatus to exchange the dies in the die holding devices in response to instructions from a computer control.

37 Claims, 13 Drawing Sheets

FIG. 9
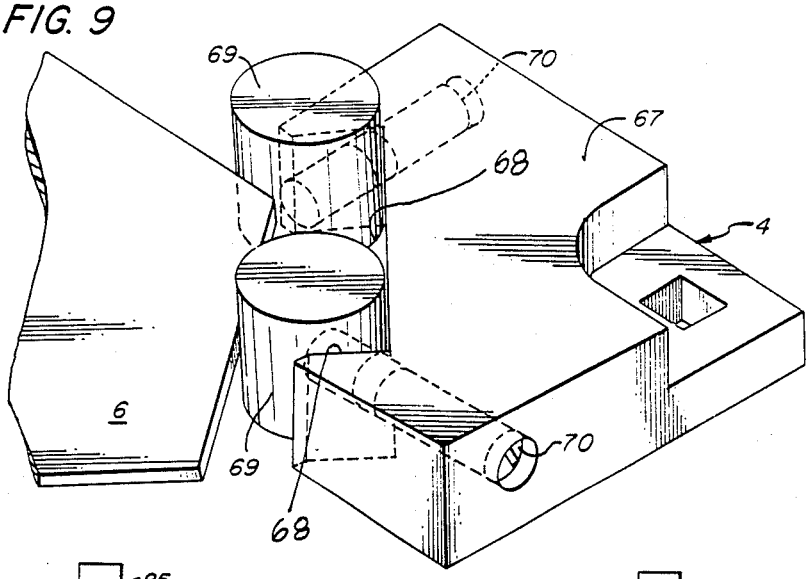
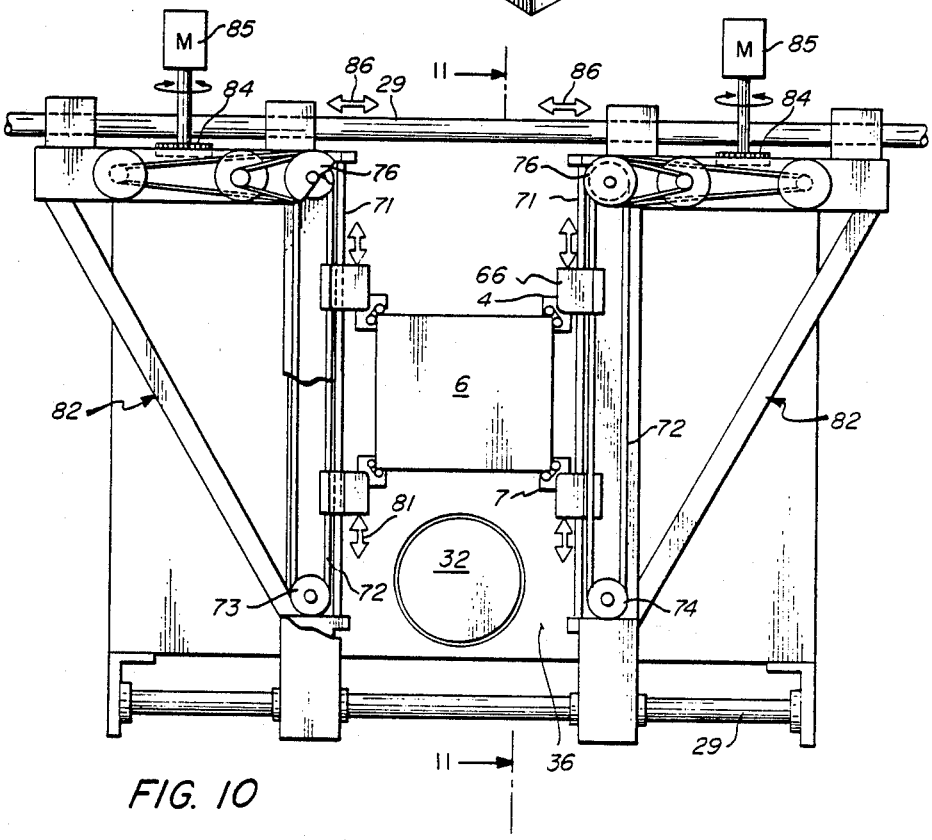
FIG. 10

BENDING PRESS FOR SHEET METAL

BACKGROUND OF THE INVENTION

The present invention is directed to bending presses for sheet metal and like workpieces wherein a top die operates in cooperation with a bottom die to bend the workpiece into conformity with the cooperating, opposed surfaces thereof. More particularly, it is directed to such bending presses in which there are included work support elements to support the workpiece in a work plane and positioning elements to move the workpiece on the support elements into predetermined positions for bending of the workpiece at multiple and precise locations thereabout.

Bending presses for sheet metal and the like are widely employed to form one or more bends. In some instances, these presses utilize complicated and expensive dies configured to provide plural bends with a single stroke of the ram operating the upper die. In still other instances, an operator manually moves the workpiece about a work table to position it with respect to a simple cooperating die set to effect a series of single bends at different positions in the workpiece. More recently, it has been proposed to include workpiece guidance systems to move the workpiece relative to the work station.

Generally, bending presses employ a stop against which the workpiece is moved to effect the desired positioning relative to the work station defined by the upper and lower dies. If the length of the workpiece to the line of the desired bend varies as multiple bends are being formed in the same workpiece, then the stop must be repositioned. Moreover, if the workpiece must be rotated to present an angularly different portion at the work station, this requires manual rotation by the operator.

In most presses, table or other support elements are provided on one side of the work station and they are located in the work support plane so that the bending operation must be conducted in a fashion which will permit the workpiece to bend upwardly; bending downwardly would be obstructed by the work support surface or table.

It is an object of the present invention to provide a novel bending press which permits precise and rapid positioning and repositioning of the workpiece relative to the work station.

It is also an object to provide such a bending press in which the workpiece may be readily rotated to present an angularly different portion at the work station.

Another object is to provide such a bending press in which the workpiece may be supported prior to the bending operation and wherein the bending operation may readily deform the extending portions either upwardly or downwardly without interference from support surfaces.

A further object is to provide such a bending press in which the cooperating dies may be readily and rapidly interchanged and in which substantially all operations may be conducted in accordance with a predetermined program by use of suitable computer control.

A still further object is to provide a novel and highly efficient method for bending sheet metal and like parts utilizing positioning elements which are rapidly and readily repositionable relative to the work station and providing abutment surfaces to precisely locate the workpiece relative to the work station.

Yet another object is to provide such a method in which multiple bending operations with different configurations and/or dimensions may be readily accomplished upon a workpiece automatically and expeditiously.

SUMMARY OF THE INVENTION

It has now been found that the foregoing and related objects and advantages can be readily attained in a novel bending press for sheet metal and the like. The press has a frame, and work support means on the frame with an upper surface defining a horizontal work support plane in which a workpiece is to be disposed. The work support means includes a pair of support elements mounted on the frame, and at least one of the elements is movably mounted on the frame for movement generally vertically relative to the horizontal work support plane with such vertical movement being effected by drive means.

Lower die support means is provided on the frame below the work support plane, and a lower die is seated in the lower die support means. Upper die support means is provided on the frame above the work support plane, and an upper die is seated in the upper die support means. One of the die support means is moved relative to the other support means and relative to the work support plane by die support drive means on the frame to effect bending of an associated workpiece disposed on the support means between the upper and lower dies.

The upper and lower dies define the work station between them, and first and second workpiece positioning means are located on opposite sides of the work station and are movable horizontally of the work support plane. Drive means is provided for effecting horizontal movement of at least one of the first and second workpiece positioning means relative to the other of the positioning means.

In the preferred embodiment, computer control means operates the several drive means of the bending press in accordance with a predetermined program. Moreover, both of the support elements are movable generally vertically relative to the horizontal work plane, and the support elements are positioned on opposite sides of the work station with their upper surfaces defining the work support plane.

Desirably, the work support elements are movable upwardly at an angle inclined towards each other and relative to the work station, and the work support means includes a rotatable support element which is positionable in the horizontal work plane and is rotatable about a vertical axis. The rotatable support element is disposed within the margins of one of the pair of support elements, and there is drive means for effecting rotation of the rotatable support element about the vertical axis in either direction of rotation.

In accordance with the preferred embodiment, the first and second workpiece positioning means are movable horizontally both in a direction extending across the work station and in a direction extending generally parallel to the work station. At least one of the first and second workpiece positioning means includes a pair of work positioning elements disposed adjacent opposite sides of one of the work support elements.

Most desirably, each of the workpiece positioning means comprises a pair of work positioning elements disposed adjacent opposite sides of the associated work support elements. Each cooperating pair of work positioning elements located along one side of the work support means is movable relative to the other cooperating pair of positioning elements, and the individual support elements along each side of the work support means are movable relative to the cooperating positioning element along that side. Preferably, each positioning means includes corner defining elements comprised of a pair of spaced apart, upstanding abutment members, the abutment member closest to the work station being spaced more closely to the side margin of the associated work support means. The abutment members have opposed vertically extending arcuate surfaces to effect centering of the corner of an associated workpiece therebetween. Most conveniently, the abutment members comprise cylindrical posts.

To clamp a workpiece against a support element, at least one hold down device is provided on the frame above the work support plane and is movable downwardly toward the work support means. Preferably, a pair of hold down devices is provided on opposite sides of the work station for cooperation with the pair of work support elements, and drive means is provided for effecting reciprocal movement of the hold down devices.

In the most desirable embodiment, the dies are removably supported in the die support means, and a magazine on the upper portion of the frame seats a multiplicity of upper dies, with the longitudinal axis thereof extending parallel to the longitudinal axis of the upper die support means. Means is provided for exchanging dies seated in the upper die support means for other dies in the magazine, and drive means operates the exchanging means. Preferably, a second die magazine is provided in the lower portion of the frame for cooperation with the lower die support means, and its magazine includes a multiplicity of lower dies. Means is provided for exchanging dies in the lower die support means with other dies in the lower die magazine, and drive means operates the exchanging means. The magazines are movable on the frame along an axis perpendicular to the die support means to effect registration of the selected dies with the die support means.

Generally and preferably, the die support drive means is disposed in the upper portion of the frame and effects reciprocation of the upper die support means relative to the lower die support means.

In the method of the present invention, a pair of opposed die holders reciprocatable relative to each other are provided to define a work station therebetween. A work support and positioning assembly is provided which includes a pair of support elements disposed to opposite sides of the work station and they define a horizontal work support plane. This assembly also includes a multiplicity of workpiece positioning elements movable horizontally along an axis perpendicular to said work station and along an axis parallel to said work station.

A workpiece is placed on the support elements of the support and positioning assembly between the positioning elements, and a first positioning element is moved to a predetermined stop position. A second positioning element is then moved towards the first positioning element to push the workpiece thereagainst. Cooperating dies configured to produce the desired bend are inserted into the die holders, and the die holders are reciprocated relative to each other to force the workpiece into conformity with the dies and to produce the desired bend.

One of the positioning elements is then moved to a second predetermined position, and the other positioning element is moved towards the first positioning element to push the workpiece thereagainst. The die holders are then reciprocated relative to each other to produce a second bend.

As will be appreciated, the dies in the die holders may be changed prior to the second bending step. Moreover, there may be provided upper and lower die magazines each containing a multiplicity of dies. If so, the method includes the additional steps of (i) moving the magazines transversely of and along one side of the die holders after the first bending step to align empty positions therein with the die holders, (ii) moving the first set of dies from the die holders into the magazines, (iii) moving the magazines to position a cooperating set of dies to form the second bend into alignment with the die holders, and (iv) moving the second set of dies from the magazines into the die holders.

Desirably, there is included the step of providing a rotatable support element, and the additional steps following the first bending step of (i) positioning the workpiece on the rotatable element, and (ii) rotating the element and thereby the workpiece to reorient it relative to the work station. A hold down device may be moved against the upper surface of the workpiece to hold it against one of the support elements.

Frequently, there is included the step of moving at least one of the support elements downwardly to provide clearance for the workpiece as it is bent by the dies. Also, there may be included the additional step of moving one of the support elements upwardly to support a portion of the workpiece in an elevated position relative to the work support plane. Two pairs of cooperating positioning elements may be provided and moved to effect the desired positioning of the workpiece. Preferably, a computer with a predetermined program performs the steps of moving the workpiece and reciprocating the die holders.

Figure 8:
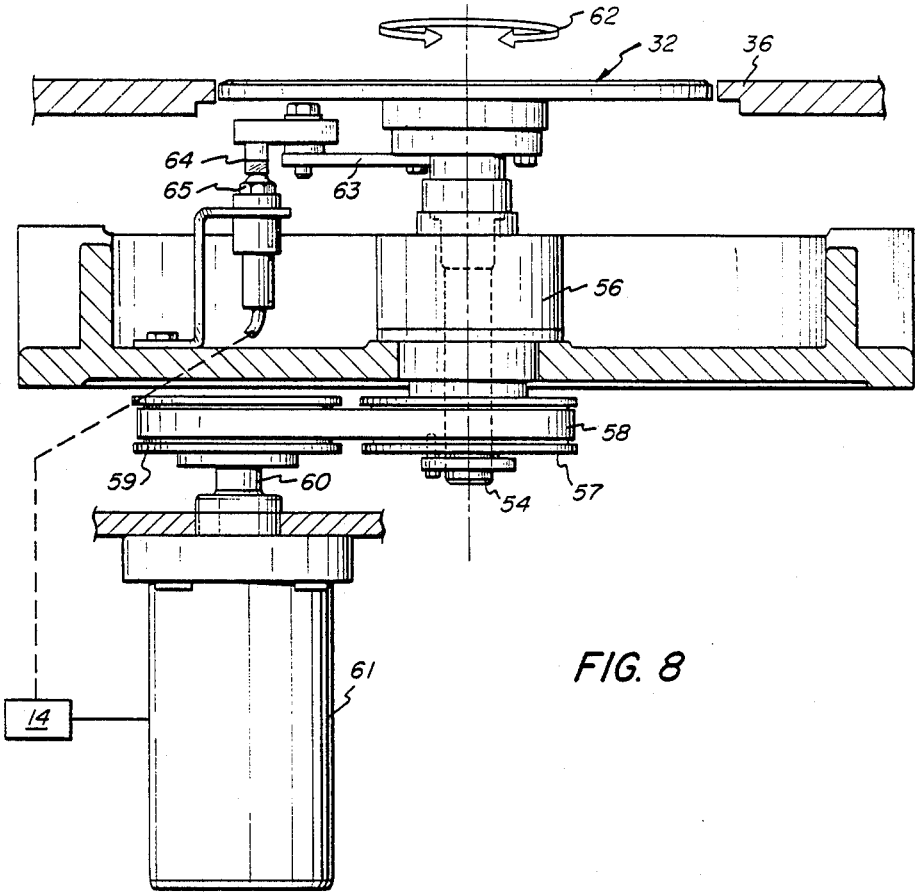
Figure 11:
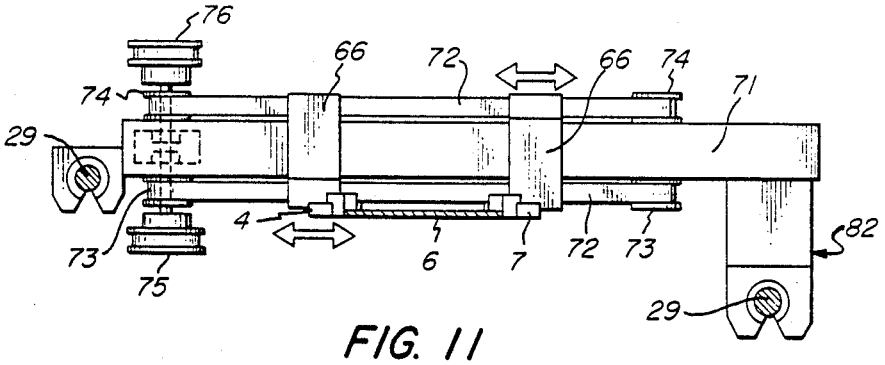
Figure 12:
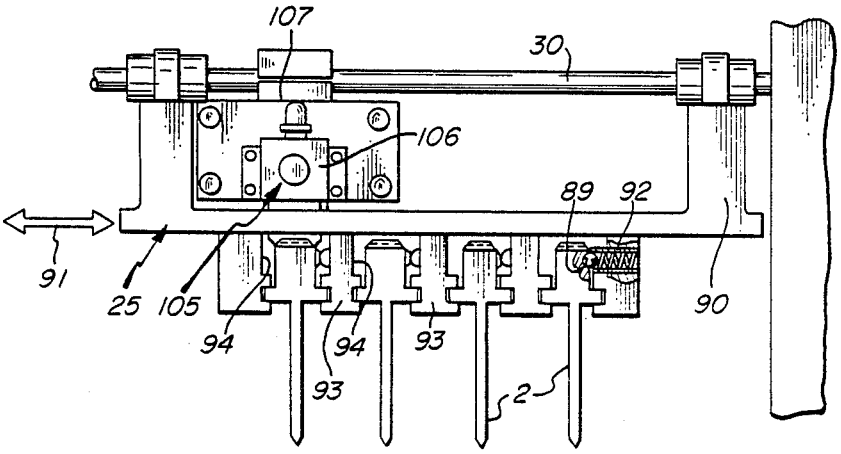
Figure 13:
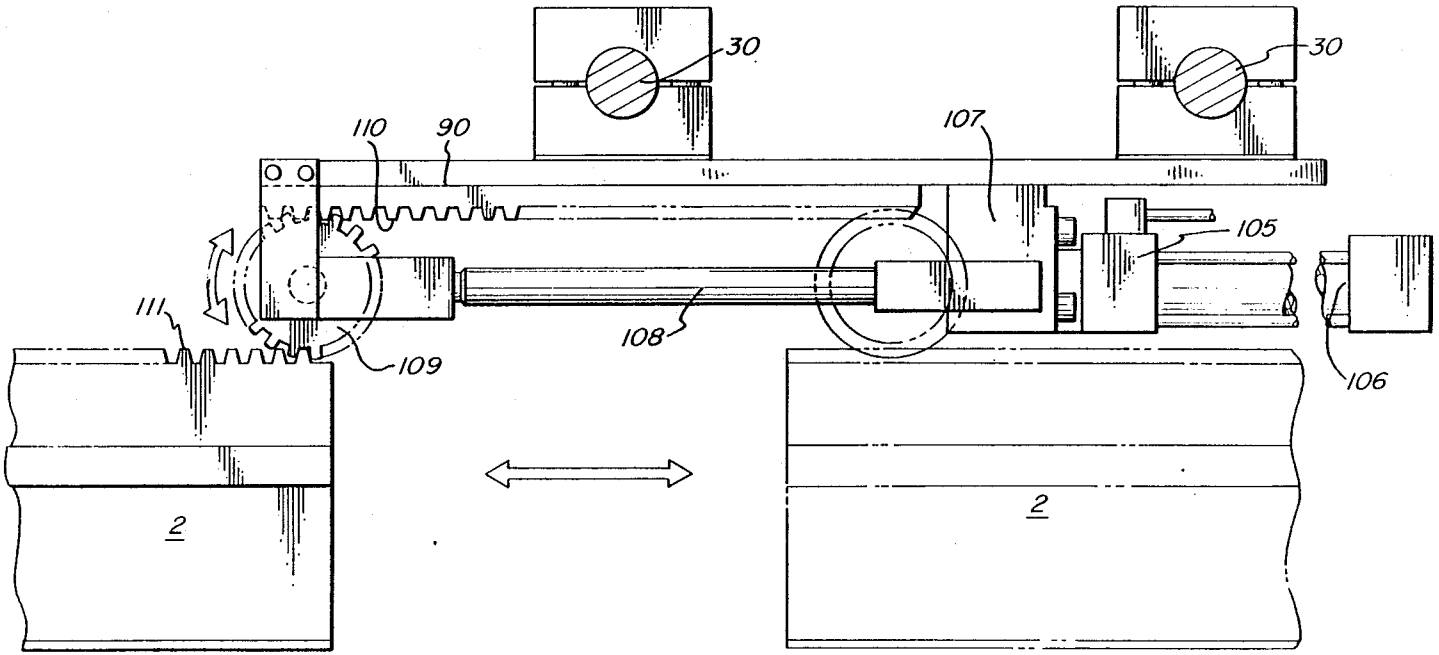
Figure 14:
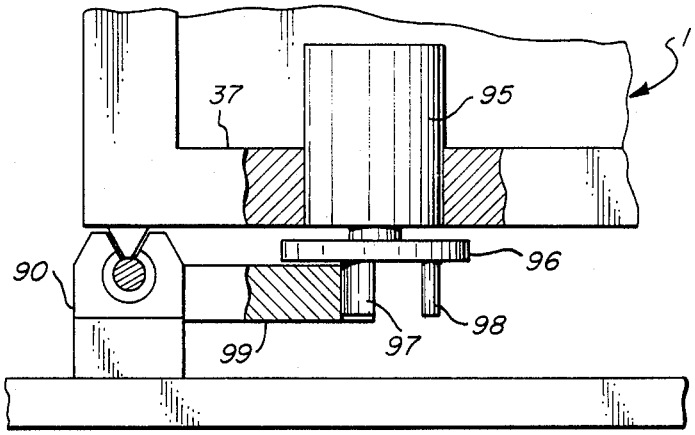
Figure 15:
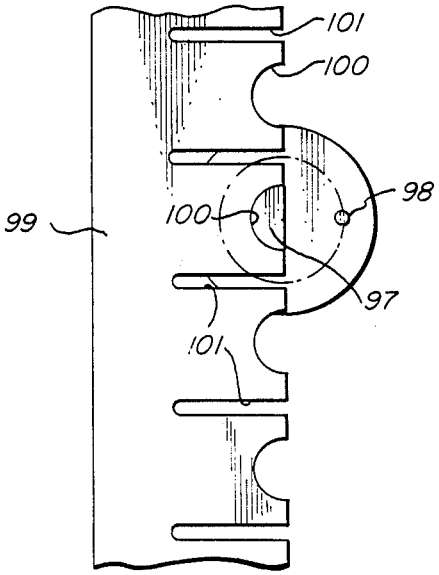

FIGS. *7a–7h* are schematic views illustrating the operations of the components effected in the bending press of the present invention;

FIG. 8 is a side elevational view in partial section of a preferred embodiment of a rotating turntable in the bending press;

FIG. 9 is a fragmentary perspective view of a preferred work positioning element used in the bending press of the present invention;

FIG. 10 is a partially schematic top view of the workpiece positioning elements and the drive assemblies therefor;

FIG. 11 is a cross-sectional view along the line 11—11 of FIG. 10 but omitting various elements for clarity of illustration;

FIG. 12 is a fragmentary, partially schematic side elevational view in partial section of the top die magazine and die change mechanism for the upper die support;

FIG. 13 is a partially diagrammatic and fragmentary front elevational view of the die change mechanism of FIG. 12;

FIG. 14 is a fragmentary end view, in partial section, of the drive assembly for moving the die magazine; and FIG. 15 is a fragmentary enlarged bottom view of the drive elements for the die magazine.

DETAILED DESCRIPTION OF THE ILLUSTRATED EMBODIMENTS

Figure 1:
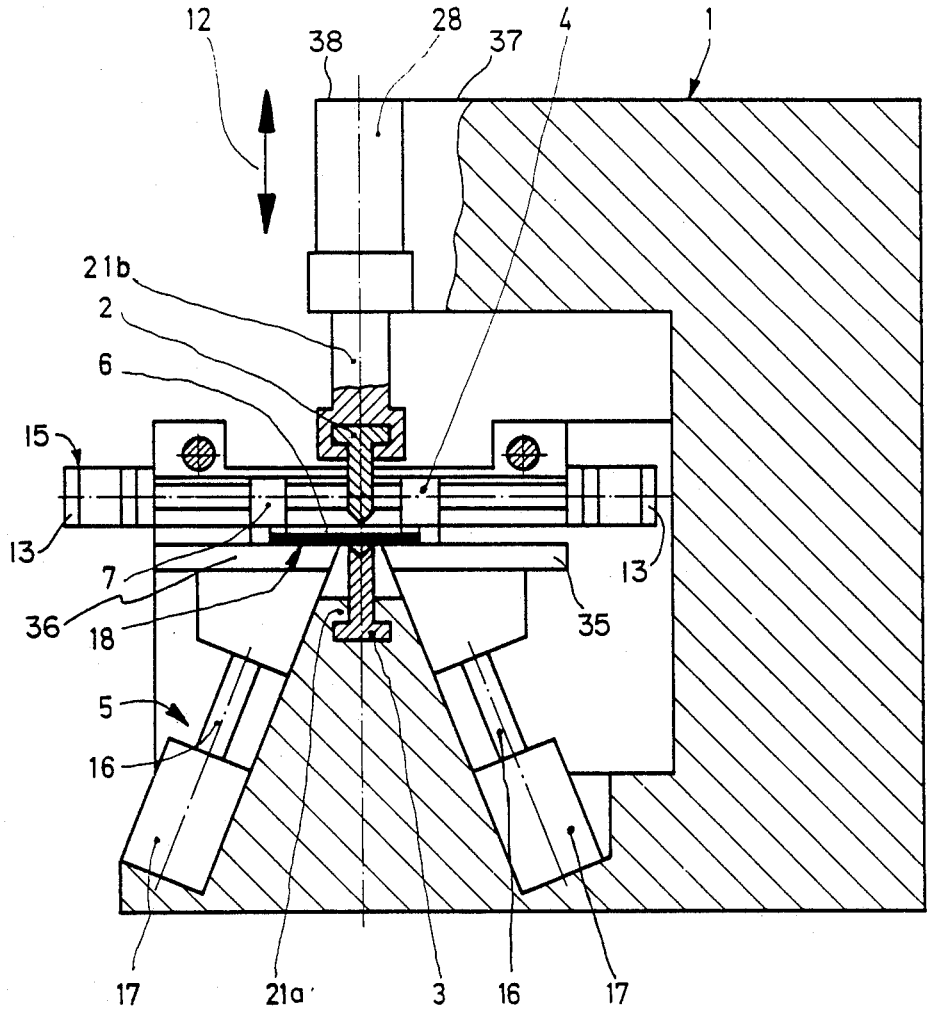
FIG. 1 is a partially diagrammatic side elevational view in partial section of a bending press embodying the present invention.
Figure 2:
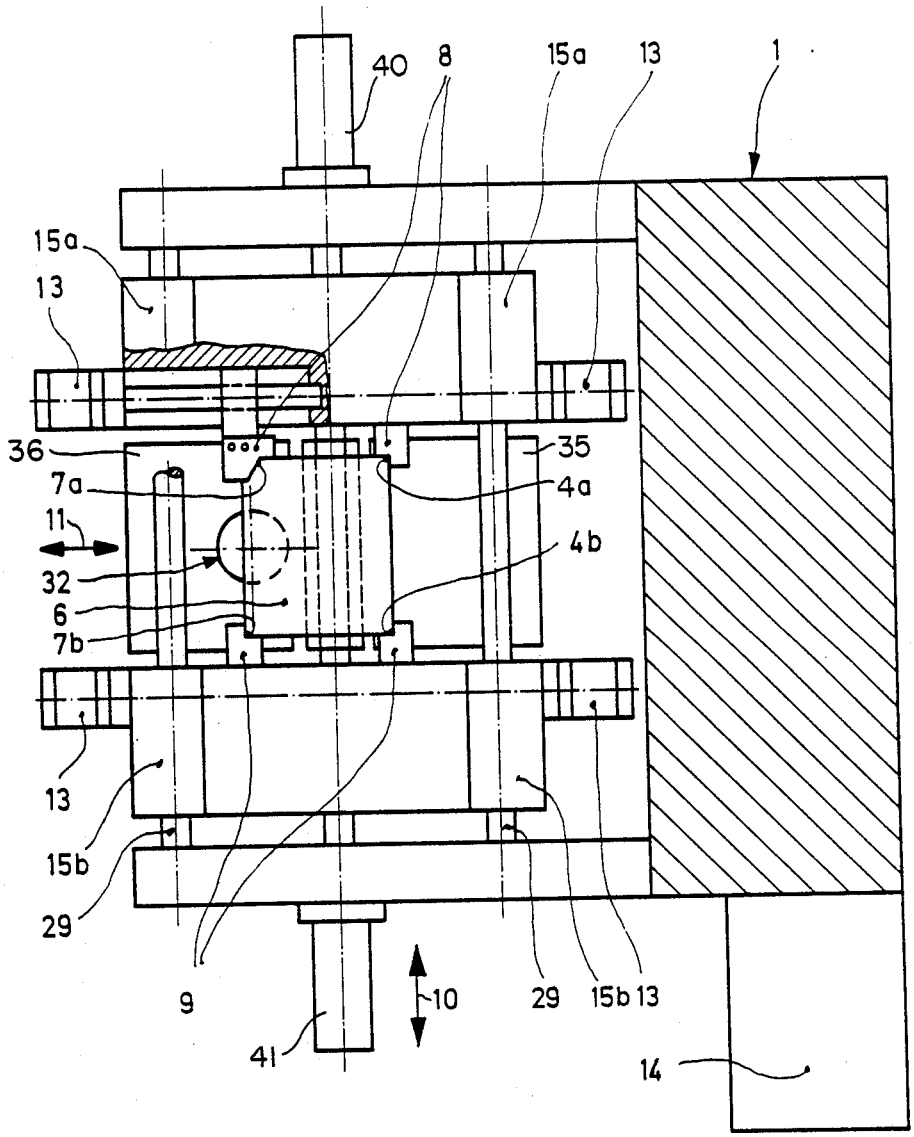
FIG. 2 is a top, partially sectional view of the bending press of FIG. 1.

Turning first to the embodiment illustrated in FIGS. 1 and 2, a bending press embodying the present invention includes a frame generally designated by the numeral 1 and upon which is mounted a work support mechanism generally designated by the numeral 5. A pair of work support elements 35, 36 are provided in the support mechanism 5 and, as shown in FIG. 1, their upper surfaces define a horizontal work support plane 18. The lower die 3 is firmly supported in the lower die holder 21*a* and is disposed between the work support elements 35, 36 with its upper surface located in the work support plane 18.

Mounted on the upper portion 37 of the frame 1 is the drive cylinder 28 and it effects reciprocation of the upper die holder 21*b* which seats the upper die 2. As shown by the arrow 12, this reciprocation is along a vertical axis aligned with the transverse center of the lower die 3; and the transverse centers of the dies 2, 3 defines the work plane 38 indicated by the dot-dash-line. Disposed on the support elements 35, 36 is a workpiece 6, and it can be seen to be located between the workpiece positioning elements 4, 7 associated with the support elements 35, 36, respectively. The positioning elements 4, 7 are movably supported on the workpiece positioning assembly generally designated by the numeral 15; motors 13 move the positioning elements 4, 7 relative to each other to position the workpiece 6 therebetween.

Also shown in FIG. 1 are the cylinders 17 which are operable to reciprocate the pistons 16 which move the support elements 35, 36 vertically and at an angle to each other or towards the work plane 38 to raise or lower the support surface provided thereby, thus accommodating bends that may have been formed in the workpiece 6, as will be discussed more fully hereinafter.

As seen in FIG. 2, there are two pairs of positioning elements 4*a*, 4*b* and 7*a*, 7*b*, with the positioning elements 4*a* and 4*b* being disposed towards the rearward portion of the frame 1 and cooperating with the rearward work support element 35. The forward pair of elements 7*a* and 7*b* cooperate with the forward work support element 36. The work positioning elements 4, 7 are supported in a workpiece positioning assembly 15 located on each side of the work support elements 35, 36 and are independently movable relative to each other by operation of the motors 13.

Moreover, it will be noted that the positioning elements 4*a* and 7*a* (which are collectively identified by the numeral 8) comprise a part of the workpiece positioning assembly 15*a*, and the positioning elements 4*b*, 7*b* which are collectively identified by the numeral 9 comprise a part of the workpiece positioning assembly 15*b*. The assemblies 15*a*, 15*b* are slidably supported on the guide rods 29 and are reciprocatable relative to each other by the cylinders 40, 41 in the direction indicated by the double headed arrow 10.

Also seen in FIG. 2 is a rotatable support element or turntable generally designated by the numeral 32 which comprises a portion of the work support element 36 and which will be described in greater detail hereinafter. In this figure, it can be seen that the positioning element 7*a* is configured especially to seat a corner of the workpiece 6.

The several drive elements for the various components illustrated in FIGS. 1 and 2 are operable by the computer control designated by the numeral 14 and thus the workpiece 6 can be precisely positioned and repositioned relative to the work station 38 defined between the upper and lower dies 2, 3.

Figure 3:
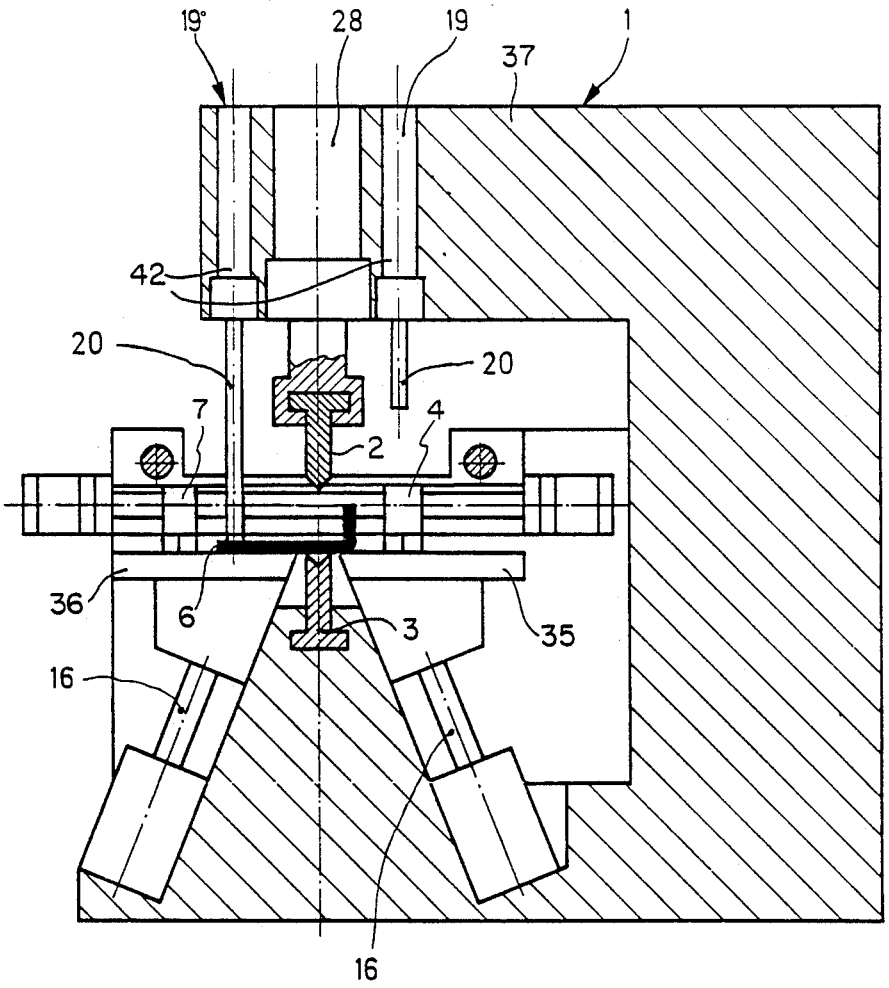
FIG. 3 is a partially diagrammatic side elevational view in partial section of another embodiment of the bending press of the present invention.

Turning now to FIG. 3, the bending apparatus is essentially similar to that described with respect to FIGS. 1 and 2 but additionally includes hold down mechanisms generally designated by the numeral 19 which are supported in the top portion 37 of the frame 1 and positioned over the work support elements 35 and 36. The hold down mechanisms 19 include the movable pins 20 which are reciprocatable by the cylinders 42. As can be seen, the left hand pin 20 has been moved downwardly to press the workpiece 6 against the work support element 36 and thus fix it in position. The pins 20 are also used to push a workpiece 6 after bending, from an inclined position resting on the lower die 3 to a horizontal position and to stabilize the workpiece 6 during various steps. In this figure, the workpiece positioning elements 4, 7 are not in abutment with the workpiece 6.

Figure 4:
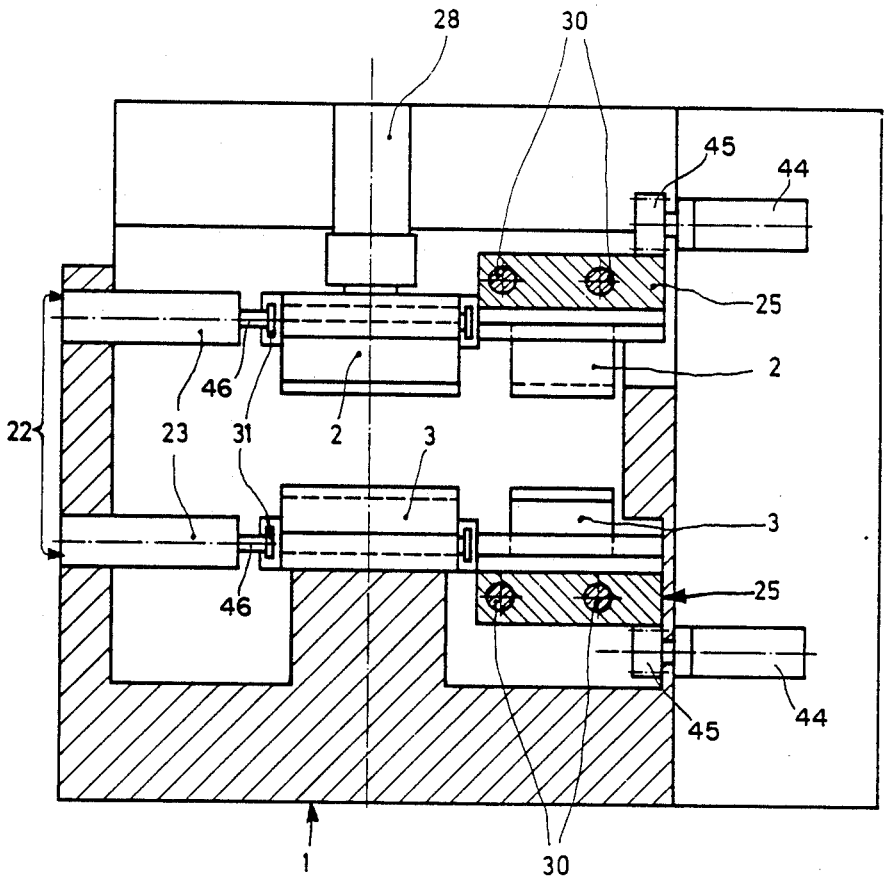
FIG. 4 is a partially diagrammatic front elevational view in partial section of still another bending press embodying the present invention.
Figure 5:
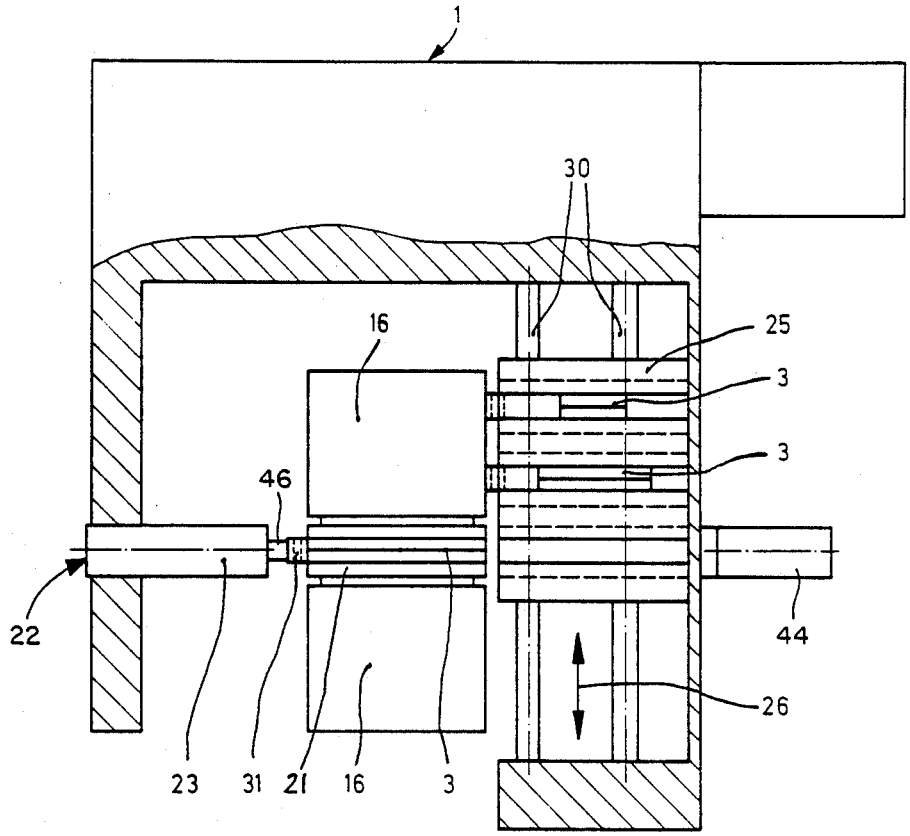
FIG. 5 is a top, partially sectional view of the embodiment of the bending press of FIG. 4.

Turning now to the embodiment of FIGS. 4 and 5, upper and lower die magazines generally designated by the numeral 25 each contain a series of differently configured and dimensioned upper dies 2 and lower dies 3. The magazines 25 are slidably supported on the guide rods 30 for movement perpendicularly to the work plane 38, as shown by the arrow 26 in FIG. 5, in response to rotation of the drive motors 44 which effect rotation of the drive gears 45 which are meshingly engaged with the adjacent surface of the magazines 25.

As best seen in FIG. 5, die changing mechanisms generally designated by the numeral 22 are located in alignment with the die holders 21 and include a drive cylinder 23 which reciprocates a piston 46 having a gripping element 31 at its outer end to engage the die. To exchange the die 2, 3 in the die holder 21, the magazine 25 is moved by the motor 44 to position an empty channel in alignment with the die holder 21. The control device 14 then actuates the cylinder 23 to extend the piston 46 and push the die 2, 3 into the empty channel of the die magazine 25. The control 14 then actuates the motor 44 to align the desired die in the magazine 25 with the die holder 25, and the control 14 then actuates the die changing mechanism 22 to grip the new die 2, 3 and draw it into the die holder 21 until it is properly seated. The die 2, 3 is then released from the gripper 31 and the piston 46 is moved to an inoperative position.

Figure 6:
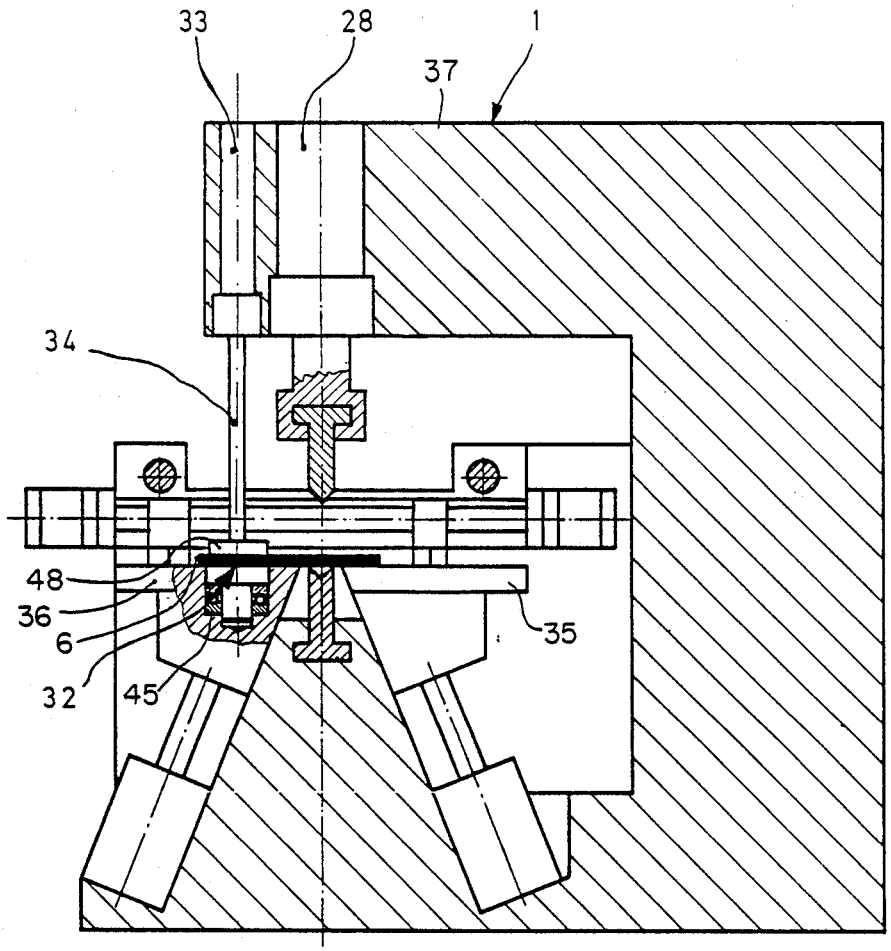
FIG. 6 is a partially diagrammatic side elevational view in partial section of a further bending press embodying the present invention.
Figure 7A:
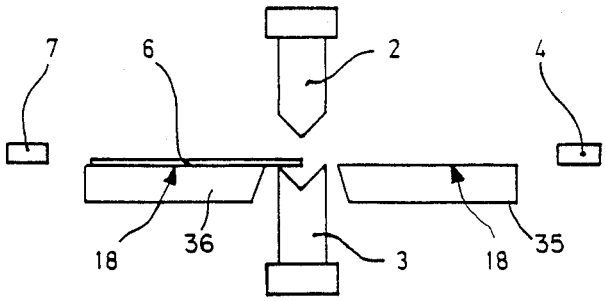
Figure 7B:
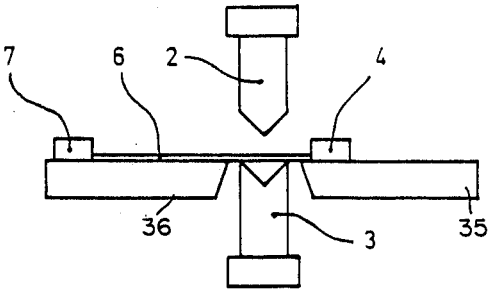
Figure 7C:
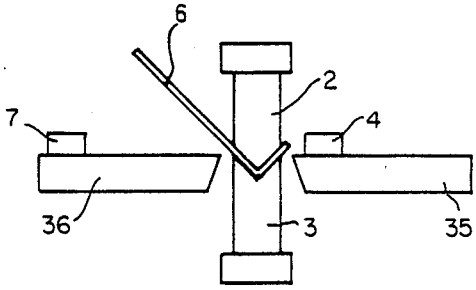
Figure 7D:
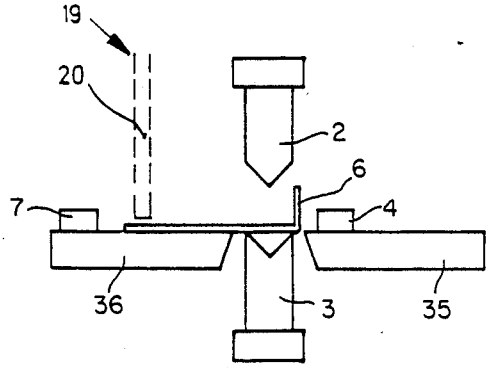
Figure 7E:
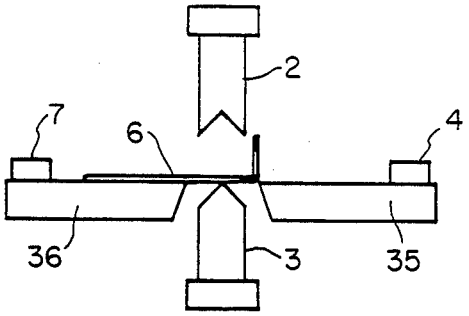
Figure 7F:
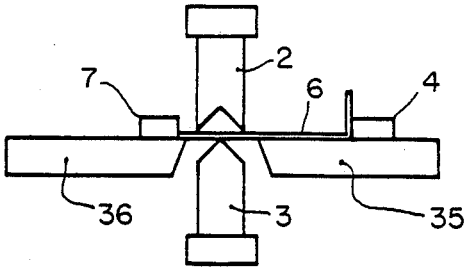
Figure 7G:
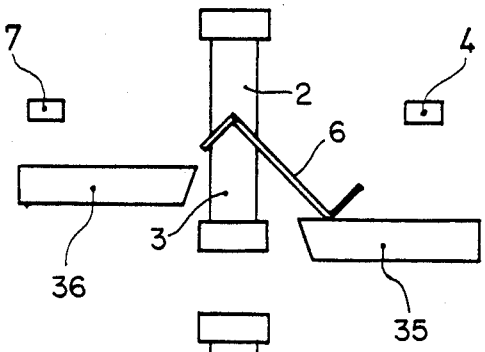
Figure 7H:
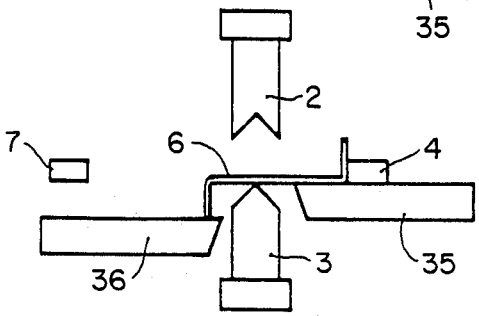

Turning now to the embodiment of FIG. 6, there is illustrated a rotatable support element 32 to enable rotation of a workpiece 6 to reorient it relative to the work plane 38. The rotating support element 32 is mounted on a bearing support 45 and is seen to have positioned thereon the workpiece 6. The workpiece 6 is held firmly thereagainst by the pressure member 34 which is moved against the upper surface of the workpiece 6 by the motor 33 located in the overhead portion 37 of the frame 1. At the lower end of the pressure member 34 is a foot 48 which frictionally bears upon the upper surface of the workpiece 6. Upon rotation of the motor 33, the foot 48 will rotate the workpiece 6 and support element 32 concurrently therewith to effect the rotational displacement of the workpiece 6. After the workpiece 6 has been rotated to the desired position, the motor 33 is actuated to move the pressure member 34 into an at rest, elevated position.

Turning now to FIG. 7, therein are schematically illustrated a number of bending steps effected in the apparatus of the present invention to produce a Z-shaped cross-section in the sheet metal workpiece 6.

In FIG. *7a*, the workpiece 6 has been placed upon the work support element 36 and the positioning elements 4 and 7 are shown in remote positions.

In FIG. *7b*, the workpiece positioning element 4 has been moved onto the work support element 35 to present a stop position for the workpiece 6, and the positioning element 7 has been moved along the support element 36 to push the workpiece 6 against the stop 4.

In FIG. *7c*, the upper die 2 has been moved downwardly to press the workpiece 6 into the recess provided in the lower die 3, causing the metal on either side to bend upwardly and make the first bend.

As seen in FIG. *7d*, the upper die 2 has been moved upwardly releasing the workpiece 6 which falls downwardly onto the work support element 36. This return to a resting position on the support element 36 may be facilitated by the hold down mechanism 19 with the pin 20 being moved downwardly to push the workpiece 6 downwardly.

Turning now to FIG. *7e*, the positioning elements 4 and 7 are moved to remote positions relative to the workpiece 6 and the dies 2 and 3 exchanged to effect a reversal of the direction of the bend next to be performed.

In FIG. *7f*, the positioning element 4 has been moved relative to the work support element 35 to its stop position, and the work positioning element 7 has been moved along the work support element 36 to push the workpiece 6 against the stop 4.

As seen in FIG. *7g*, the upper die 2 has been moved downwardly against the workpiece 6 to form the workpiece 6 about the lower die 3, and to bend the metal downwardly on both sides of the die 3. Simultaneously, the support elements 35 and 36 have been moved downwardly to allow the ends of the workpiece 6 to pivot downwardly as a result of the bending operation.

Turning now to FIG. *7h*, the workpiece support element 35 has been moved upwardly as the upper die 2 has been moved upwardly, and the workpiece 6 has been pivoted about the lower die 3 to locate the workpiece 6 with its principal portion in a horizontal plane so that it may be discharged from the bending machine by action of the positioning elements.

Turning now to FIG. 8, therein illustrated is a preferred rotating work support element assembly. As seen, the rotating support element 32 is disposed within an aperture formed in the support element 36 and their upper surfaces are coplanar. The rotating support element 32 is mounted upon a shaft 54 which is journaled in the bearing assembly 56. At its lower end, the shaft 54 has mounted thereon a pulley 57, and the drive belt 58 extends thereabout and about the pulley 59 which is mounted upon the shaft 60 of the motor 61.

As will be appreciated, the motor 61 can be turned in either direction of rotation in response to commands from the computer control 14, as indicated by the arrow 62. Mounted on the lower surface of the rotating element 32 is a switch actuator arm 63 with a contact element 64 at its outer end. At one position of rotation, the switch element 64 will come into contact with the fixed switch 65 transmitting a signal to the control 14 to terminate rotation. This enables the table element 32 to be precisely positioned with the contacts 64 and 65 predetermining the initial or at rest position of the rotating table element 32 so that the degree of rotation desired can be effected from that known starting position.

Turning now to FIG. 9, a preferred construction for the positioning elements 4, 7 is therein illustrated. Each of the positioning elements 4, 7 includes a mounting block 67 which has one of its corners cut out to provide a pair of diagonally spaced recesses 68 in which are seated the cylindrical posts 69 so as to define a spacing therebetween. The posts 69 are secured in position upon the block 67 by the mounting screws 70. As can be seen, a nonrectangular edge of the workpiece 6 will, when the positioning element 4 moves thereagainst, or the workpiece 6 is moved against the positioning element 4, center itself between the cylindrical posts 69. This greatly facilitates the positioning of workpieces with corners or contours which are not rectangular.

Turning now to FIGS. 10 and 11, therein illustrated is a preferred construction for the drive mechanisms to effect the motion of the positioning elements 4 and 7 relative to each other and of the positioning assemblies 15 relative to each other. In this embodiment, the work positioning elements 4, 7 are supported on brackets 66 which are slidably mounted on the guide bars 71 and drivingly engaged with the drive belts 72. The drive belts 72 in turn extend about the pulleys 73, 74. The rearward pulleys 73, 74 are mounted upon shafts which also mount drive pulleys 75, 76 which seat drive belts 77, 78 which in turn are drivingly engaged with upper drive motor 79 and lower drive motor 80.

The motors 79 and 80 are rotatable in either direction of rotation to effect motion of the positioning elements 4 and 7 in either direction as shown by the arrows 81. These several components are in turn mounted upon and carried by the positioning assembly frames generally designated by the numeral 82 and which in turn are slidably supported on the guide rods 29. The rearward portion of the positioning assembly frame 82 has a rack surface (not shown) which is meshingly engaged with a pinion gear 84 on the shaft of the drive motor 85 so that the entire assembly may be moved in either direction, as seen by the arrows 86, upon rotation of the motor 85 in the desired direction of rotation. As a result, the workpiece positioning elements 4, 7 on the positioning assembly frames 82 may be moved towards each other in a direction parallel to the work plane 38, and the individual positioning elements 4, 7 may be moved relative to the other positioning element on the same positioning assembly frame 82 by actuation of the motors 79 and 80 through direction of the control means 14.

Turning now to FIGS. 12–15, therein illustrated is a preferred embodiment of the die magazine and changing assembly. The illustrations are for the upper die, but the structure and principles are applicable to the lower die.

The die magazine 25 includes a frame 90 which is slidably mounted on the slide bars 30 for reciprocation as indicated by the arrows 91 in FIG. 12. Depending from the frame 90 are the die supports 93 defining therebetween a multiplicity of channels or slots 94 for seating a multiplicity of dies 2, and spring loaded detent pins 92 on the supports 93 seat in recesses 89 in the sides of the dies 2 to firmly secure them in position.

As seen in FIGS. 14 and 15, a drive motor 95 is mounted on the upper portion 37 of the machine frame 1 and rotates the drive member 96 which has a semicircular cam surface 97 and a diametrically spaced pin 98 depending therefrom. Mounted on the carriage frame 90 is a bar 99 having alternating semicircular recesses 100 and slots 101. No motion occurs during the portion of the time that the cam surface 97 is sliding in the recesses 100, and the carriage frame 90 is moved along the bars 30 when the pin 98 is disposed in one of the slots 101. The semicircular recesses 100 are aligned with channels 94 to position the carriage frame 90 firmly in an indexed position in registry with the die support 21.

The transfer of the dies 2 between the channels 94 and the die support 21 is effected by the die changer assembly generally designated by the numeral 105. A hydraulic or pneumatic drive cylinder 106 is mounted on a bracket 107 which is fixedly positioned on the slide bars 30 in alignment with the die support 21, and it has a piston rod 108 with a rotatably mounted pinion gear 109 at its outer end. Mounted firmly on the bracket 107 above, and drivingly engaged with, the pinion gear 109 is a rack gear 110. The upper edge of the several dies 2 is provided with a rack gear surface 111 which is drivingly engaged with the lower circumference of the pinion gear 109. As a result, extension or retraction of the piston rod 108 produces rotation of the pinion gear 109 and moves the die 2 into or from the slot 94 which is registry with the die changer assembly 105 and die support 21.

As will be readily appreciated from the foregoing detailed description of the drawings, the apparatus and method of the present invention greatly simplifies and speeds the alignment of the workpiece relative to the work station defined between the bending dies. Moreover, computer control of the various steps is facilitated by the simplicity and versatility of operation of various components. Moreover, since the positioning of the workpiece relative to the work station is controlled by the positioning elements, use of robots or other workpiece loading devices to place the workpiece upon the work support table is greatly facilitated. It is only necessary that the workpiece be disposed between the positioning elements which can, for purposes of the loading operation, be moved to the extreme remote positions thereof.

Although it is possible to use but a single pair of positioning elements, one of which functions as the adjustable stop and the other of which functions as the pushing element to locate the workpiece against the stop, obviously more precise and more versatile positioning is enabled by using at least three and preferably two pairs of positioning elements. In this fashion, a pair of elements on one side of the work station may move the workpiece smoothly and firmly against a pair of work stops on the other side of the work station. Moreover, the positioning elements at one end of the work station can be utilized to push the workpiece sideways along the work station (i.e., parallel to the longitudinal axis of the dies) and against the positioning elements at the other end of the work station. Moreover, more complicated configurations, rather than simple rectangles, can be readily accommodated by use of four positioning elements.

As an alternative, a third positioning element may be positioned between the first and second positioning elements which will be located on opposite sides of the work station. The third positioning element is displaced laterally towards the other end of the work station. One of the first two positioning elements may be used to shift the workpiece along the third positioning element towards the other of the first two positioning elements. Alternatively, the third positioning element may be utilized to push the workpiece against the first and second positioning elements.

As previously indicated, the use of four positioning elements allows them to function as corner engaging members. By using the preferred construction with a pair of arcuate surfaces for each of the positioning elements, centering of nonrectilinear corners can readily be effected. Alternatively, inserts can be mounted on the positioning elements for different contours.

The nature of the support elements which comprise the support member can vary. In the illustrated embodiment, they are shown as being solid surfaces. Obviously, the surface can comprise a grating or perforated metal structure if so desired, for simplicity of cleaning and avoidance of buildup of debris. However, it is extremely beneficial to have two totally separate support elements, each movable independently, and located on the opposite sides of the work station.

The forming part of the bottom die, (i.e., the top of its groove, or its apex in the event of reversal), is correlated with the support plane defined by the support so that the upper end of the side faces of a grooved bottom die, or the apex of a pointed bottom die, will lie in the plane defined by the work support. The various drive mechanisms utilized in the press of the present invention may comprise electric motors, hydraulic motors, pneumatic motors, or other suitable actuators. The choice will depend upon the action intended and the force required. Rotary motion may be converted into linear motion by using a pinion gear and a rack or like device. Linear motion of a piston may be converted to rotary motion by utilizing a piston having a rotary gear engaged with a rack or like device.

By utilizing separate drive means for the various movable elements of the press, and by connecting each of the drives to the computer control, maximum versatility is obtained and maximum speed of operation may be readily effected. The positioning elements utilized in the bending press of the present invention comprise an extension of known X, Y positioning devices and the techniques utilized in connection with such known devices are readily adapted to the presses of the present invention, particularly with respect to computer control and programming.

By supporting the positioning elements independently of the work support elements, the work support elements may be shifted upwardly and downwardly as necessary to accommodate the bending motion of the workpiece and to avoid any interference therewith. Raising and lowering of the separate support elements on opposite sides of the work station can be timed to coincide with the bending taking place in the workpiece, thereby providing support for the workpiece until it is fully engaged between the cooperating dies and thereafter to support the workpiece when the dies are opened.

By the provision of the hold down devices, the workpiece can be clamped against a support surface as the positioning elements are moved relative thereto, or as the turntable is actuated to rotate the workpiece, or as the dies are opened to produce an unstable condition of the workpiece upon the lower die or one of the support elements. Moreover, by using the hold down devices, the workpiece can be tipped downwardly about the fulcrum point provided by the lower die to dispose it on one or the other of the individual work support elements.

In the illustrated embodiment, the tool magazine is one which is moved linearly and across the plane of the work station. It will be apparent that the tool magazine may comprise a rotatable carousel with the dies carried thereby, and which would be rotated into an indexed position aligned with the die support. At this point, the dies would be engaged and moved by a suitable die transfer mechanism. The use of separate tool magazines for the top and bottom dies allows maximum versatility and rapid high speed automatic operation.

By providing the rotatable support element to effect a change in orientation of the workpiece, it can be seen that all four edges of a rectangular sheet can be bent by the same pair of cooperating dies, forming a series of single fold lines. Two parallel fold lines can be initially formed by indexing the workpiece perpendicularly to the work station. The workpiece can then be moved onto the rotating support element and rotated 90° . It is then repositioned to form the third fold perpendicular to the previous folds and then indexed to form the last of the four folds which will be parallel to the third fold. Another possible construction for effecting the rotation of the workpiece is to provide rotatable die supports which are utilized to clamp the workpiece therebetween and then to rotate the workpiece, after which the clamping action would be released and the workpiece moved to its desired orientation on the work support surface.

With the die magazines of the illustrated embodiment, it can be seen that the dies within the magazines can be changed during operation of the machine. This enables a variety of operations to be performed sequentially and rapidly without the necessity for machine shutdown.

Thus, it can be seen from the foregoing detailed specification and attached drawings that the bending press of the present invention provides a high degree of versatility and permits rapid, multiple bending operations in a single workpiece. Moreover, the positioning elements and support elements enable precise positioning of the workpiece and bending in either direction relative to the horizontal plane. The workpiece may be automatically rotated to reorient it relative to the work station, and it may be closely controlled during the various bending steps. Moreover, by providing a multiplicity of dies in die magazines and die changing apparatus to effect interchange of dies between the die supports and the die magazines, bends of different contours and/or dimensions may be quickly and rapidly effected.

Having thus described the invention, what is claimed is:

1. In a bending press for sheet metal, the combination comprising:

(a) a frame;

(b) work support means on said frame having an upper surface defining a horizontal work support plane in which a workpiece is to be disposed and including a pair of support elements mounted on said frame, at least one of said elements being movably mounted on said frame for movement generally vertically relative to said horizontal work support plane;

(c) drive means on said frame for effecting said relative vertical movement of at least one of said support elements;

(d) lower die support means on said frame below said work support plane;

(e) a lower die removably supported in said lower die support means;

(f) upper die support means on said frame above said work support plane;

(g) an upper die removably supported in said upper die support means;

(h) die support drive means on said frame for movement of one of said die support means relative to the other support means and relative to said work support plane to effect bending of an associated workpiece disposed on said support means between said upper and lower dies, said dies defining the work station between them;

(i) first and second workpiece positioning means located on opposite sides of said work station and movable horizontally of said work support plane;

(j) drive means for effecting horizontal movement of at least one of said first and second workpiece positioning means relative to the other of said positioning means;

(k) a magazine on the upper portion of said frame seating a multiplicity of upper dies, said dies having the longitudinal axis thereof extending parallel to the longitudinal axis of said upper die support means;

(l) means for exchanging dies seated in said upper die support means for other dies in said magazine; and (m) drive means for said die exchanging means.

2. The bending press in accordance with claim 1 wherein there is included computer control means for operating the several drive means of the bending press in accordance with a predetermined program.

3. The bending press in accordance with claim 1 wherein both of said support elements are movable generally vertically relative to said horizontal work plane.

4. The bending press in accordance with claim 3 wherein said pair of movable support elements are positioned on opposite sides of said work station with their upper surfaces defining said work support plane.

5. The bending in accordance with claim 3 wherein said work support elements are movable upwardly along axes extending at angles inclined towards each other relative to said work station and with their upper surfaces parallel during said upward movement.

6. The bending press in accordance with claim 1 wherein said work support means includes a rotatable support element positionable in said horizontal work plane and rotatable about a vertical axis.

7. The bending press in accordance with claim 6 wherein said rotatable support element is disposed within the margins of one of said pair of support elements and wherein said bending press includes drive means for effecting rotation of said rotatable support element about said vertical axis in either direction of rotation.

8. The bending press in accordance with claim 1 wherein said first and second workpiece positioning means are movable horizontally both in a direction extending across said work station and in a direction extending generally parallel to said work station.

9. The bending press in accordance with claim 1 wherein at least one of said first and second workpiece positioning means includes a pair of work positioning elements disposed adjacent opposite sides of one of said work support elements.

10. The bending press in accordance with claim 9 wherein each of said workpiece positioning means comprises a pair of work positioning elements disposed adjacent opposite sides of the associated work support elements.

11. The bending press in accordance with claim 10 wherein each cooperating pair of work positioning elements located along one side of the work support means is movable relative to the other cooperating pair of positioning elements, and the individual support elements along each side of said work support means are movable relative to the cooperating positioning element along that side.

12. The bending press in accordance with claim 1 wherein each positioning means includes corner defining elements comprised of a pair of spaced apart, upstanding abutment members, the abutment member closest to the work station being spaced more closely to the side margin of the associated work support means, said abutment members having opposed vertically extending arcuate surfaces to effect centering of the corner of an associated workpiece therebetween.

13. The bending press in accordance with claim 12 wherein said abutment members comprise cylindrical posts.

14. The bending press in accordance with claim 1 wherein said bending press includes at least one hold down device on said frame above said work support plane and movable downwardly toward said work support means to clamp a workpiece therebetween.

15. The bending press in accordance with claim 14 wherein a pair of hold down devices are provided on opposite sides of said work station for cooperation with said work support elements, and drive means are provided for effecting reciprocal movement of said hold down devices.

16. The bending press in accordance with claim 1 wherein a second die magazine is provided in the lower portion of said frame for cooperation with said lower die support means, said magazine including a multiplicity of lower dies, means for exchanging dies in said lower die support means with other dies in said lower die magazine, and drive means for such exchanging means.

17. The bending press in accordance with claim 1 wherein said magazine is movable on said frame along an axis perpendicular to said upper die support means to effect registration of the selected die with the die support means.

18. The bending press in accordance with claim 1 wherein said die support drive means is disposed in the upper portion of said frame and effects reciprocation of said upper die support means relative to said lower die support means.

19. In a bending press for sheet metal, the combination comprising:

(a) a frame;

(b) work support means on said frame having an upper surface defining a horizontal work support plane in which a workpiece is to be disposed and including a pair of support elements mounted on said frame, said elements being movably mounted on said frame for movement generally vertically relative to said horizontal work support plane;

(c) drive means on said frame for effecting said relative vertical movement of said support elements;

(d) lower die support means on said frame below said work support plane;

(e) a lower die in said lower die support means;

(f) upper die support means on said frame above said work support plane;

(g) an upper die in said upper die support means, said upper and lower dies being removably supported in said die support means;

(h) die support drive means on the upper portion of said frame for movement of said upper die support means relative to the lower die support means and relative to said work support plane to effect bending of an associated workpiece disposed on said support means between said upper and lower dies, said dies defining the work station between them, said pair of movable support elements being positioned on opposite sides of said work station;

(i) first and second workpiece positioning means located on opposite sides of said work station and movable horizontally of said work support plane, said first and second workpiece positioning means being movable horizontally both in a direction extending across said work station and in a direction extending generally parallel to said work station;

(j) drive means for effecting horizontal movement of at least one of said first and second workpiece positioning means relative to the other of said positioning means;

(k) a magazine on the upper portion of said frame seating a multiplicity of upper dies, said dies having the longitudinal axis thereof extending parallel to the longitudinal axis of said upper die support means, said magazine being movable on said frame along an axis perpendicular to said upper die support means to effect registration of the selected die with said die support means;

(l) means for exchanging dies seated in said upper die support means for other dies in said magazine;

(m) drive means for such exchanging means; and (n) computer control means for operating the several drive means of the bending press in accordance with a predetermined program.

20. The bending press in accordance with claim 19 wherein said work support means includes a rotatable support element positionable in said horizontal work plane and rotatable about a vertical axis.

21. The bending press in accordance with claim 20 wherein said rotatable support element is disposed within the margins of one of said pair of support elements and wherein said bending press includes drive means for effecting rotation of said rotatable support element about said vertical axis in either direction of rotation.

22. The bending press in accordance with claim 19 wherein at least one of said first and second workpiece positioning means includes a pair of work positioning elements disposed adjacent opposite sides of one of said work support elements.

23. The bending press in accordance with claim 22 wherein each of said workpiece positioning means comprises a pair of work positioning elements disposed adjacent opposite sides of the associated work support elements.

24. The bending press in accordance with claim 23 wherein each cooperating pair of work positioning elements located along one side of the work support means is movable relative to the other cooperating pair of positioning elements, and the individual support elements along each side of said work support means are movable relative to the cooperating positioning element along that side.

25. The bending press in accordance with claim 19 wherein said bending press includes at least one hold down device on said frame above said work support plane and movable downwardly toward said work support means to clamp a workpiece therebetween.

26. The bending press in accordance with claim 19 wherein a second die magazine is provided in the lower portion of said frame for cooperation with said lower die support means, said magazine including a multiplicity of lower dies, means for exchanging dies in said lower die support means with other dies in said lower die magazine, and drive means for such exchanging means.

27. In a bending press for sheet metal, the combination comprising:

(a) a frame;

(b) work support means on said frame having an upper surface defining a horizontal work support plane in which a workpiece is to be disposed and including a pair of support elements mounted on said frame, at least one of said elements being movably mounted on said frame for movement generally vertically relative to said horizontal work support plane, said support means including a rotatable support element positionable in said horizontal work plane and rotatable about a vertical axis;

(c) drive means on said frame for effecting said relative vertical movement of at least one of said support elements;

(d) lower die support means on said frame below said work support plane;

(e) a lower die in said lower die support means;

(f) upper die support means on said frame above said work support plane;

(g) an upper die in said upper die support means;

(h) die support drive means on said frame for movement of one of said die support means relative to the other support means and relative to said work support plane to effect bending of an associated workpiece disposed on said support means between said upper and lower dies, said dies defining the work station between them;

(i) first and second workpiece positioning means located on opposite sides of said work station and movable horizontally of said work support plane; and (j) drive means for effecting horizontal movement of at least one of said first and second workpiece positioning means relative to the other of said positioning means.

28. The bending press in accordance with claim 27 wherein there is included computer control means for operating the several drive means of the bending press in accordance with a predetermined program.

29. The bending press in accordance with claim 27 wherein said rotatable support element is disposed within the margins of one of said pair of support elements and wherein said bending press includes drive means for effecting rotation of said rotatable support element about said vertical axis in either direction of rotation.

30. In a bending press for sheet metal, the combination comprising:

(a) a frame;

(b) work support means on said frame having an upper surface defining a horizontal work support plane in which a workpiece is to be disposed and including a pair of support elements mounted on said frame, at least one of said elements being movably mounted on said frame for movement generally vertically relative to said horizontal work support plane;

(c) drive means on said frame for effecting said relative vertical movement of at least one of said support elements;

(d) lower die support means on said frame below said work support plane;

(e) a lower die in said lower die support means;

(f) upper die support means on said frame above said work support plane;

(g) an upper die in said upper die support means;

(h) die support drive means on said frame for movement of one of said die support means relative to the other support means and relative to said work support plane to effect bending of an associated workpiece disposed on said support means between said upper and lower dies, said dies defining the work station between them;

(i) first and second workpiece positioning means located on opposite sides of said work station and movable horizontally of said work support plane both in a direction extending across said work station and in a direction extending parallel to said work station; and (j) drive means for effecting horizontal movement of both least one of said first and second workpiece positioning means relative to the other of said positioning means.

31. The bending press in accordance with claim 30 wherein there is included computer control means for operating the several drive means of the bending press in accordance with a predetermined program.

32. In a bending press for sheet metal, the combination comprising:

(a) a frame;

(b) work support means on said frame having an upper surface defining a horizontal work support plane in which a workpiece is to be disposed and including a pair of support elements mounted on said frame, at least one of said elements being movably mounted on said frame for movement generally vertically relative to said horizontal work support plane;

(c) drive means on said frame for effecting said relative vertical movement of at least one of said support elements;

(d) lower die support means on said frame below said work support plane;

(e) a lower die in said lower die support means;

(f) upper die support means on said frame above said work support plane;
(g) an upper die in said upper die support means;
(h) die support drive means on said frame for movement of one of said die support means relative to the other support means and relative to said work support plane to effect bending of an associated workpiece disposed on said support means between said upper and lower dies, said dies defining the work station between them;
(i) first and second workpiece positioning means located on opposite sides of said work station and movable horizontally of said work support plane, at least one of said workpiece positioning means comprising a pair of work positioning elements disposed adjacent opposite sides of the associated work support element, each cooperating pair of work positioning elements located along one side of the work support means being movable relative to the other cooperating pair of positioning elements, and the individual support elements along each side of said work support means being movable relative to the cooperating positioning element along that side; and
(j) drive means for effecting horizontal movement of at least one of said first and second workpiece positioning means relative to the other of said positioning means.

33. The bending press in accordance with claim 32 wherein there is included computer control means for operating the several drive means of the bending press in accordance with a predetermined program.

34. In a bending press for sheet metal, the combination comprising:
(a) a frame;
(b) work support means on said frame having an upper surface defining a horizontal work support plane in which a workpiece is to be disposed and including a pair of support elements mounted on said frame, at least one of said elements being mounted on said frame for movement generally vertically relative to said horizontal work support plane;
(c) drive means on said frame for effecting said relative vertical movement of at least one of said support elements;
(d) lower die support means on said frame below said work support plane;
(e) a lower die in said lower die support means;
(f) upper die support means on said frame above said work support plane;
(g) an upper die in said upper die support means;
(h) die support drive means on said frame for movement of one of said die support means relative to the other support means and relative to said work support plane to effect bending of an associated workpiece disposed on said support means between said upper and lower dies, said dies defining the work station between them;
(i) first and second workpiece positioning means located on opposite sides of said work station and movable horizontally of said work support plane, each positioning means including corner defining elements comprised of a pair of spaced apart, upstanding abutment members, the abutment member closest to the work station being spaced more closely to the side margin of the associated work support means, said abutment members having opposed vertically extending arcuate surfaces to effect centering of the corner of an associated workpiece therebetween; and
(j) drive means for effecting horizontal movement of at least one of said first and second workpiece positioning means relative to the other of said positioning means.

35. The bending press in accordance with claim 34 wherein there is included computer control means for operating the several drive means of the bending press in accordance with a predetermined program.

36. The bending press in accordance with claim 34 wherein said abutment members comprise cylindrical posts.

37. In a bending press for sheet metal, the combination comprising:
(a) a frame;
(b) work support means on said frame having an upper surface defining a horizontal work support plane in which a workpiece is to be disposed and including a pair of support elements mounted on said frame, both of said elements being movably mounted on said frame for movement generally vertically relative to said horizontal work support plane, said pair of movable support elements being positioned on opposite sides of said work station with their upper surfaces defining said work support plane, said work support elements being movable upwardly along axes extending at angles inclined toward each other relative to said work station and with their upper surfaces parallel during said upward movement;
(c) drive means on said frame for effecting said relative vertical movement of at least one of said support elements;
(d) lower die support means on said frame below said work support plane;
(e) a lower die in said lower die support means;
(f) upper die support means on said frame above said work support plane;
(g) an upper die in said upper die support means;
(h) die support drive means on said frame for movement of one of said die support means relative to the other support means and relative to said work support plane to effect bending of an associated workpiece disposed on said support means between said upper and lower dies, said dies defining the work station between them;
(i) first and second workpiece positioning means located on opposite sides of said work station and movable horizontally of said work support plane;
(j) drive means for effecting horizontal movement of at least one of said first and second workpiece positioning means relative to the other of said positioning means;
(k) support elements are movable generally vertically relative to said horizontal work plane;
(l) pair of movable support elements are positioned on opposite sides of said work station with their upper surfaces defining said work support plane; and
(m) work support elements are movable upwardly at an angle inclined towards each other and relative to said work station.

* * * * *

UNITED STATES PATENT AND TRADEMARK OFFICE

CERTIFICATE OF CORRECTION

PATENT NO. : 4,753,099

DATED : June 28, 1988

INVENTOR(S) : Hans Klingel

It is certified that error appears in the above-identified patent and that said Letters Patent is hereby corrected as shown below:

Column 17, line 41, before "mounted", insert -- movably --.

Signed and Sealed this

Thirteenth Day of December, 1988

*Attest:*

DONALD J. QUIGG

*Attesting Officer*

*Commissioner of Patents and Trademarks*